US006772697B2

(12) United States Patent
Stephan et al.

(10) Patent No.: US 6,772,697 B2
(45) Date of Patent: Aug. 10, 2004

(54) ARRANGEMENT OF SERVICE POSITIONS FOR MAINTENANCE APPARATUSES ON A TEXTILE MACHINE

(75) Inventors: Adalbert Stephan, Beilngries/Paulushofen (DE); Karl Zöpfl, Ingolstadt (DE); Harald Widner, Ingolstadt (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 10/176,360

(22) Filed: Jun. 20, 2002

(65) Prior Publication Data

US 2003/0089266 A1 May 15, 2003

(30) Foreign Application Priority Data

Jun. 23, 2001 (DE) ..... 101 30 467

(51) Int. Cl.[7] ..... B61K 5/00

(52) U.S. Cl. ..... 104/264; 198/345.3; 57/268; 57/271

(58) Field of Search ..... 104/264, 272; 198/349.3, 345.3; 57/261, 263, 268, 271

(56) References Cited

U.S. PATENT DOCUMENTS 3,360,914 A * 1/1968 Black, Jr. et al. ..... 57/261
3,724,192 A * 4/1973 Cardoz ..... 57/261
4,028,869 A * 6/1977 Schafer et al. ..... 57/264
4,043,106 A * 8/1977 Stahlecker ..... 57/263
4,498,283 A * 2/1985 Kodama et al. ..... 57/261
4,611,463 A * 9/1986 Smith et al. ..... 57/263
4,840,022 A * 6/1989 Karl et al. ..... 57/263
5,568,720 A * 10/1996 Teich et al. ..... 57/281
6,474,461 B1 * 11/2002 Grabovszky ..... 198/345.3

FOREIGN PATENT DOCUMENTS

DE 3942916 A1 7/1991
DE 3942916 A1 * 7/1991 ..... D01H/15/013

OTHER PUBLICATIONS

German Patent Office Search Report, Mar. 1, 2002.
Patent Abstracts of Japan No. 08246275, Sep. 24, 1996.

* cited by examiner

*Primary Examiner*—S. Joseph Morano
*Assistant Examiner*—Lars Olson
(74) *Attorney, Agent, or Firm*—Dority & Manning

(57) ABSTRACT

The invention concerns an arrangement of service positions for maintenance apparatus, which can travel on a guide rail along a multiplicity of similar workstations on a first side of a textile machine, wherein a maintenance apparatus in a first service position at the elevation of a machine framing of the textile machine can be pivoted away from, or transversely withdrawn from the guide rail. Per side of the textile machine, at least two maintenance apparatuses are exclusively assigned thereto, whereby the guide rail on the first side, at least at one end of the textile machine, is elongated beyond the textile machine and a second service position is placed on the elongated guide rail. In this way, it becomes possible, with a large number of workstations to assure the shortest possible duration of a standstill, wherein in the case of a failure or preventive unkeep of one maintenance apparatus, another maintenance apparatus can serve a workstation in a short time.

13 Claims, 2 Drawing Sheets

ARRANGEMENT OF SERVICE POSITIONS FOR MAINTENANCE APPARATUSES ON A TEXTILE MACHINE

DESCRIPTION

The invention concerns an arrangement of service positions for maintenance apparatuses, which apparatuses can travel along a multiplicity of similar workstations on a side of a textile machine.

In the case of a known spinning machine (DE 36 02 961 A1), a plurality of similar workstations are situated lying beside one another on both sides of the spinning machine. On each these two sides, runs one guide rail, upon which maintenance apparatuses travel along the line of workstations. The two guide rails are connected together at one end of the spinning machine in a U-curve, so that, in case of need, a maintenance apparatus normally serving one side, can be changed over to the other side. This would occur upon the failure of one maintenance apparatus. For such failure or for the repair of a maintenance apparatus itself, service stations have been constructed along the guide rail, at which maintenance apparatuses can be repaired outside of the confines of the workstations. In one embodiment, at the level of an end framing of a spinning machine, two oppositely disposed service stations are provided, one on each side of said machine. Maintenance apparatuses, in a withdrawal action, can be run into one these said service stations in a direction transverse to the guide rail. In another embodiment, the guide rail is extended in length beyond the end structure, so that the maintenance apparatus is switched onto the elongated guide rail and subjected to its own upkeep in this location. For the switching of the maintenance apparatus from one side of the spinning machine to the other side, the maintenance apparatus is provided with a curve adapted running gear in order to negotiate the U-curve. The travel around the U-curve upon the change from a first to a second side of the spinning machine and back again, requires travel time, during which the workstations are not being serviced.

In the case of another known spinning machine (DE 199 30 644 A1), on both sides of the machine, a guide rail is provided along which two maintenance apparatuses can service a multiplicity of workstations. The maintenance apparatuses themselves are carried on running gear which can be pulled out transversely of the guide rail. By means of this withdrawal of the maintenance apparatus on the its running gear, a passage between the spinning machine and the back side of the maintenance apparatus is formed, so that the same is accessible from that rear side. This pulling out of the maintenance apparatus into an inspection position is provided at the level of the end structure of the spinning machine. For this withdrawal operation, an appropriate mechanism is available.

SUMMARY

Thus it is a principal purpose of the invention to provide an arrangement for service positions for maintenance apparatuses on a spinning machine, wherein, upon a failure or needed upkeep of a maintenance apparatus, the workstations assigned to this maintenance apparatus can be attended to by another maintenance apparatus with the least possible expenditure of time, while the time and expense for mechanical reconstitution of the failure or scheduled repair of the out-of-service maintenance apparatus is minimized to the greatest possible extent.

In accord with an embodiment according to the invention, there is to be found on one side of a textile machine, two maintenance apparatuses, which can travel along a multiplicity of similar workstations. The maintenance apparatuses, in this function, are automated, and undertake at the said workstations, various operative steps, for instance, the cleaning of the workstation, the restarting of the workstation upon its dropping out of production, or the feeding in of starting products or the like. In the case of an open-end spinning machine, for example, by means of a spin-start robot, a spool exchange can be effected, when the spool is filled with spun thread, or in the case of a thread break, a restart of the spinning machine is carried out. By means of the provision of at least two maintenance apparatuses, the apparatuses can apportion between themselves the maintenance operations at the workstations. Thus, more workstations can be serviced and/or each workstation can be put back into productive operation immediately after a shorter period of downtime.

Advantageously, with this arrangement, the individual maintenance apparatuses can be assigned specific areas of operation at the workstations. The workstations would then be primarily serviced by the appropriate maintenance apparatus.

Because of the fact that at least two maintenance apparatuses run on only one side of a textile machine, the travel times to the individual workstations are substantially shortened. This reduces the response time for the maintenance apparatus at a workstation, especially if one of the maintenance apparatuses fails because of a defect, or must be taken out of service due to preventive upkeep. By this means, the number of the workstations per side of a textile machine can be substantially increased, so that, for instance, even coarse yarn can be efficiently spun, for which a much more frequent spool exchange becomes necessary.

Because of the travel of more than one maintenance apparatus on a common guide rail, the maintenance apparatuses cannot pass by one another. On this account, two service positions are provided along the guide rail, at which, respectively, one maintenance apparatus can be attended. Simultaneously, it is quite possible that the other maintenance apparatus would not be obstructed in providing service to all the workstations on that same side. On this account, the service positions for the maintenance apparatuses lie in a part of the guide rail which is outside of the operational area for the workstations.

Due to the provision of a pivotal or withdrawable service position at the level of the framing of the textile machine, it is not necessary to elongate the textile machine in this area beyond its normal length. In the case of a spinning machine, a machine-end framing, a drive framework or an end framing are available. The end framing is also provided to support the furnishing of empty spools and for the removal of filled spools.

The pull-out arrangement of the maintenance apparatus into a withdrawn service position is effected by the withdrawal of a section of the guide rail in the area of the mentioned framings. When this is done, the maintenance apparatus remains in place on this withdrawn guide rail section. By means of this withdrawal of the maintenance apparatus, it becomes possible for service personnel to gain access to its rear side between the maintenance apparatus and the textile machine framing.

Again, when a pivotally secured service position is concerned, advantageously, a section of the guide rail at the level of the machine framing is swung around a bearing.

Because of this, the maintenance apparatus on the swung out section is likewise accessible from the rear.

In the case of a second service position, the guide rail is elongated beyond the basic length of the textile machine, so that the maintenance apparatus, when it is pushed into the extended guide rail length, may be approached from all sides.

The maintenance apparatuses are supported directly on their respective guide rail so that by means of a simple construction operation, a lockup can be provided for the maintenance apparatus. This permits an exact positioning of the maintenance apparatus on the workstation. Because of the fact that a maintenance apparatus serves only those workstations on its respective side of the textile machine, an optimal adjustment of the maintenance apparatus on the guide rail for the corresponding side is made possible. It is not necessary that adjustment of the maintenance apparatus be adapted for usage on the guide rails for the two different sides of the textile machine.

In a particularly advantageous embodiment, the two service positions are placed at opposite end areas of the guide rail on one side of the textile machine. In this way, in the case of a dropout of one of the maintenance apparatuses, the other maintenance apparatus is enabled to take care of the entire work area of the workstations, without being obstructed by the maintenance apparatus removed for failure or needed preventive upkeep.

By the provision of at least two maintenance apparatuses on the second side of the textile machine, to comprise a further embodiment, it is possible that also on this side the workstations can be served with only a short interruption. In this case, it is particularly advantageous in that a third service position be placed opposite to the service position on the other side of the textile machine, which, in the same height as the machine structure can be transversely withdrawn. The mechanical construction for the withdrawal of the guide rail transverse to its run, permits its fastening on only one of the machine supports, which simplifies the carrying out of the withdrawal.

In the case of the arrangement of a service position for maintenance apparatuses in accord with another embodiment, the guide rails are elongated at both ends of the textile machine and thereby a service position is provided. This enables a particularly simple mechanical assembly, since only an extension of the guide rail must be made. For the rest, the above named advantages also apply to this arrangement also.

In the case of an arrangement of service positions for maintenance apparatuses as set forth in still another embodiment, two service positions are provided on one side of the textile machine, respectively at the same level as a machine framing. When this arrangement is employed, it is not necessary to lengthen the textile machine by running a guide rail beyond the basic length of the machine, so that, in regard to the length of the textile machine, no additional loss of space is experienced. If, on the other hand, the textile machine exhibits two stretches of adjacent workstations on one side, which are bound to one another by the machine framing, then, even in this case, in the framing between these workstations, a transverse, pull-out service position can be provided. This enables, for example, the use of a third maintenance apparatus, which is dedicated to one side, without the necessity that this maintenance apparatus must be driven into an end area of the workstation, whereby it would blockade another maintenance apparatus. Beyond this, the above presented advantages are found in this arrangement.

In a particularly favored embodiment, one, several or all service positions are so arranged, that these, in regard to the closest neighboring workstation, occupy at least a distance of 30 cm. That means that as soon as a maintenance apparatus is in its service position, then this is only a distance of 30 cm away from the nearest workstation. This permits the repair, that is to say, the upkeep of a maintenance apparatus, while it is still operational on this textile machine side. An advantage of this arrangement is that the maintenance personnel are not exposed to the danger of coming into contact with a component of the workstation which is in motion. The productive operation of the textile machine can be carried on in spite of the upkeep operations on the maintenance apparatus while, at the same time, the workplace safety of the maintenance personnel is assured. Particularly advantageous in this arrangement, would be a distance to the workstation of at least 80 cm.

Particularly advantageous are the oppositely disposed service positions on the machine framing which can be pulled out by a common withdrawal device, whereby altematingly, the maintenance apparatus on one or the other side of the textile machine can be brought into its upkeep station. In this way, the oppositely situated guide rail sections can be connected by a common cross carrier, which, for this operation, requires only a sliding bushing.

With the aid of the drawings, embodiments of the invention will be desfribed and explained in greater detail.

DETAILED DESCRIPTION

Reference will now be made in detail to embodiments of the invention depicted in the figures. Each embodiment is presented for sake of explanation of the invention, and not meant as a limitation of the invention. It is intended that the present invention include modifications and variations to the embodiments shown and described herein.

Figure 1:
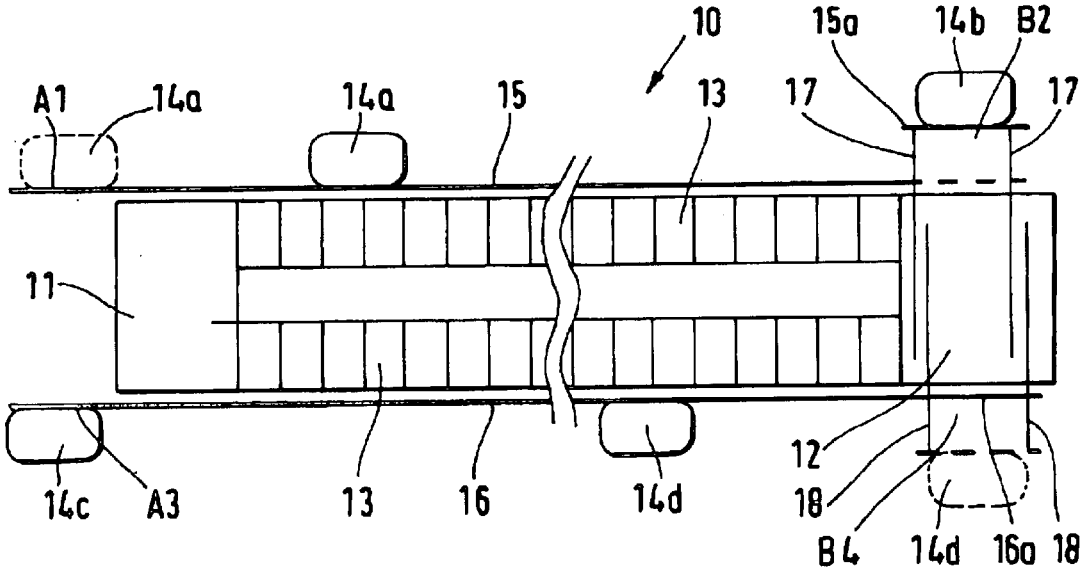
FIG. 1 a schematic plan view of a rotor spinning machine with four service stations to comprise a first embodiment, FIG. 2 a schematic plan view of a rotor spinning machine with an arrangement of four service stations to comprise a second embodiment, FIG. 3 a schematic plan view of a rotor spinning machine with four service stations to comprise a third embodiment, and FIG. 4 a schematic plan view of a rotor spinning machine with one machine framing and two service stations mounted thereon between the workstations.

FIG. 1 shows a schematic plan view of a rotor spinning machine 10 with an arrangement of four service stations A1, A3, B2 and B4 comprising a first embodiment. Between an end framing 11 and a drive framework 12 of the rotor spinning machine 10, is a multiplicity of adjacently situated workstations 13 on both sides of the spinning machine 10. The end framing 11 serves, for instance, for a known feed of empty spools and for the removal of full spools. In the drive framework 12, again in a known manner, is located the drive aggregate for the entire, common drive of the workstations 13.

In actuality, there is found between the framings 11 and 12, an essentially greater number of workstations 13 than shown, which is indicated by the break-lines. Normally, the number of such workstations 13 runs up to 200 to 300. By the provision of at least two spin-start robots per side of the rotor spinning machine 10, the number of the workstations 13, which are to be served by the spin-start robot 14, can be increased. For example, with two spin-start robots 14, the count per side would be up to about 300 or more workstations 13. With 3 spin-start robots 14, then the count per side would be up to about 450 or more workstations 13.

The spin-start robot 14 and the robots, which are described by the following embodiments, serve for the restart of spinning the threads, the exchange of spools, the cleaning of the workstations 13, the placement of a new fiber band on the fiber feed and like tasks, in already known operations.

Parallel to the workstations 13, guide rails 15, 16 run along both sides of the rotor spinning machine 10, respectively. On these guide rails 15, 16, the spin-start robot is carried by running gear which, in a known manner, is movably borne on the guide rails 15, 16. The two guide rails 15, 16, on the left side (as seen in the plan view of FIG. 1) are extended outward beyond the end framing 11. The elongation measures at least the width of a spin-start robot 14. The extension of the guide rail 15 forms, in this arrangement, the service station A1, preferably for the spin-start robot 14*a*. The extension of the guide rail 16 forms the service station A3, preferably for the spin-start robot 14*c*. After the spin-start robot 14*a* is run into the service station A1, or similarly, the spin-start robot 14*c* docks in the service station A3, then, either spin-start robot is freely accessible from its rear side. The rear side of the spin-start rotor 14, in this matter, is called that side, which in operation, confronts the workstation 13. On the rear side of the spin-start robot 14 is to be found, essentially, the mechanical elements and test devices which are necessary for the service of the workstation 13 and which, on this account, require frequent monitoring, that is to say, frequent maintenance visits.

The care of the spin-start robot 14 is done, in this arrangement, in a known manner by means of (not shown) drag-chains, which run parallel to the workstations 14. In these drag-chains are laid the supply lines for the spin-start robot 14, such as the electrical service, a compressed air line, a suction line for vacuum operation and the like.

On the right side of the rotor spinning machine 10 (as seen in the plan view of FIG. 1), at the level of the drive framework 12 is carried a section 15*a*, 16*a* of the guide rail 15, 16 on a rod 17, 18, and by means of the rod 17, 18 the section may be pulled out transverse to the guide rail 15 or 16. The upkeep of the spin-start rotor 14*b* is done, preferably, at the service station B2 and the upkeep of the spin-start robot 14*d* is preferably done at the service station B4. The guide rail sections 15*a* and 16*a* can be pulled out on the rods 17 and 18 about a distance of 50 cm to 1 meter. This allows the maintenance personnel, when the guide rail sections 15*a* and 16*a* are withdrawn, access for service work on the rear sides of the spin-start robots 14*b* and 14*d*. The rods 17 and 18 are on the upper side of the drive framework 12 and are carried in sliding bushings or roller bearings, so that the guide rail sections 15*a* and 16*a*, in spite of the spin-robot 14*b*, 14*d* carried thereon, can be easily withdrawn.

If the spin-start robot 14*b* or 14*d* is brought, respectively, into the service station B2 or B4, then the spin-start robot is run along the guide rail 15 or 16 onto the guide rail section 15*a*, 16*a*. With the said rods 17, 18 run in, then the guide sections 15*a* and 16*a* are aligned with the guide rails 15 and 16, so that the spin-start rotor 14*b*, 14*d* can travel onto the guide rail sections 15*a* and 16*a* without hindrance. As soon as the spin-start robot 14*b* and 14*d* are on the guide rail sections 15*a* and 16*a*, then it is locked in position and by this locking, the rods 17, 18 may be released. Subsequently, the spin-start robot 14*b*, 14*d* is brought into the withdrawn position, where it is once again locked, for safety reasons, in this withdrawn position. In this withdrawn position, the spin-start robot 14*b*, 14*d* is connected, now as before, to an (not shown) interconnect cable which is a flexible extension of the supply lines. In the interconnect cable, the supply lines are run parallel to the workstation in a known manner.

When the spin-start robot 14*a* is in its service station A1, then the second: spin-start robot 14*b* can take care of workstations over the entire stretch of the rotor spinning machine 10. Conversely, when the spin-start robot 14*b* is in its service station B2, then, the workstations 13, can again be served by the spin-start robot 14*a* over the entire stretch as described. Corresponding procedure is also valid for the spin-start robots 14*c* and 14*d* in regard to the service station A3, B4 on the opposite side of the rotor spinning machine 10.

Figure 2:
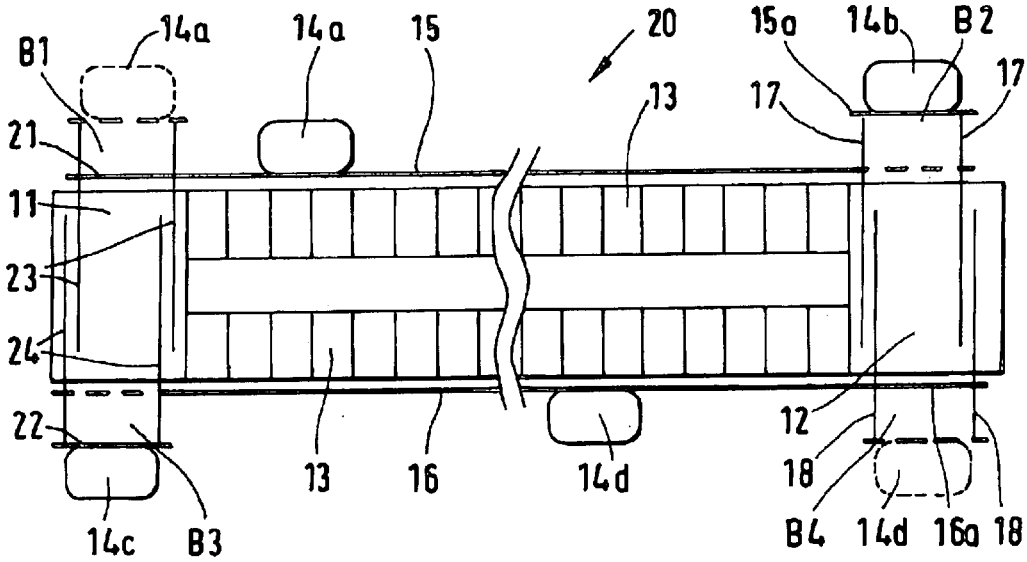

FIG. 2 shows a schematic plan view of a rotor spinning machine 20 with the service stations B1 to B4, to comprise a second embodiment. The elements, which correspond to the first embodiment, are designated by the same reference numbers. In the following, only the difference from the first embodiment will be described. In this second embodiment, the service stations A1 and A3 are dispensed with. Instead of these, at the level of the end framing 11 the two service stations B1 and B3 are provided. As in the case of the drive framework 12 of the first embodiment, in this case, at the level of the end framing 11, two guide rail sections 21 and 22 are provided, which can be pulled out on a rod 23, 24, again transverse to the guide rails 15, 16. Corresponding to the above described service station B2, B4, here the spin-start robots 14*a*, 14*c*, in the service stations B1, B3 can be withdrawn and serviced from the rear side. The withdrawal rods 23, 24 are here, likewise, carried in sliding bushings or by roller bearings, so that the spin-start robots can be easily withdrawn on the guide rail sections 21, 22.

Figure 3:
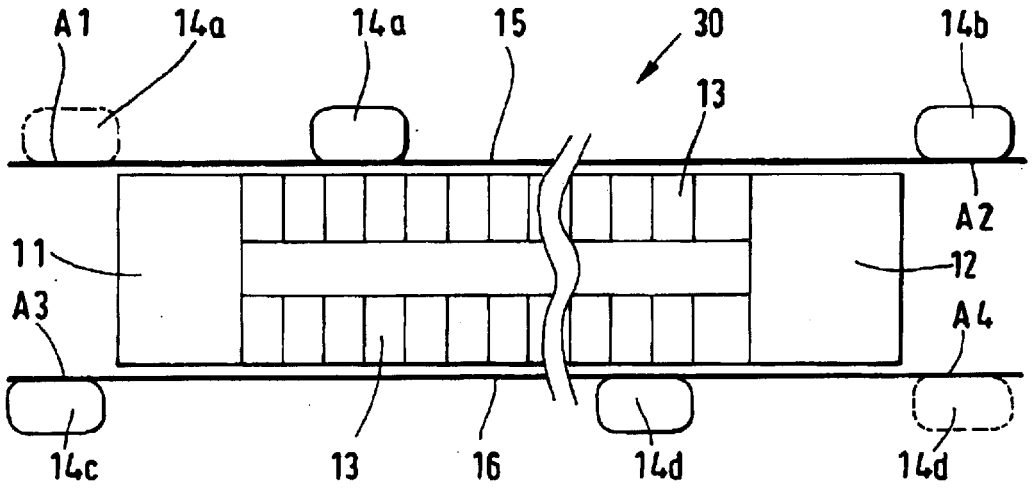

FIG. 3 shows a schematic plan view of a rotor spinning machine 30 with four service station A1 to A4, comprising a third embodiment. Not considering the service stations A2, A4, on the extended guide rails 15, 16 on the right side of the rotor spinning machine 30, are the same elements with the same reference numbers as in the first embodiment of FIG. 1. Instead of the service station B2, B4 of the first embodiment, which can be withdrawn, in this third embodiment the guide rails 15, 16 are extended out beyond the drive framework framing 12. The length of the extension measures, in this instance, at least the width of a spin-start robot 14. Corresponding to the service station A1, A3, of the first embodiment, in this third embodiment the spin-start robots 14*b*, 14*d* in the service station A2, A4 can be serviced from the rear side. Also in this case, the interconnect cable lies along the extended guide rails 15, 16, so that the spin-start robot 14*b*, 14*d* is completely connected in the service station A2, A4 by means of the supply lines with a supply apparatus of the rotor spinning machine 30.

Figure 4:
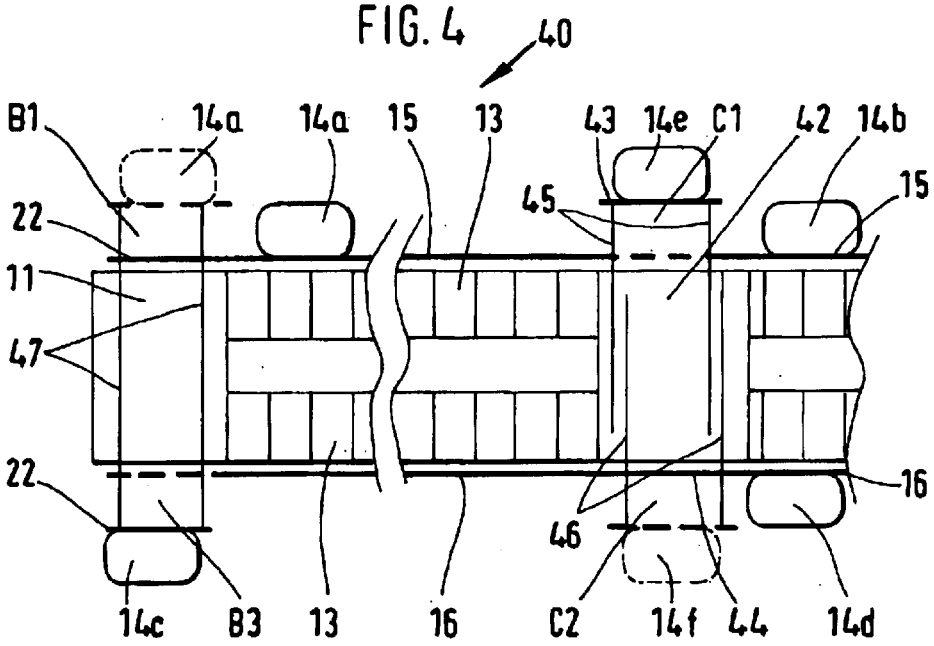

FIG. 4 shows in schematic plan view a rotor spinning machine 40, in the case of which four service stations B1, B3, C1, C2 comprise a fourth embodiment. The same elements as in the second embodiment are designated with the same reference numbers. In the fourth embodiment, a drive framework is not placed at the end of the rotor spinning machine 40, but lies between sections of several, adjacently situated workstations 13.

The drive framework 42 can drive the drive the workstations 13 on both sides, or, for example, only on the left side (as seen in the plan view of FIG. 4). In the latter case, an additional drive framework, for example, is provided (not shown) on the right end of the rotor spinning machine 40. At the height of the drive framework 42, the stations C1, C2 are provided. The service station C1, C2 includes a guide rail section 43, 44, which, in the run-in condition, aligns itself with the guide rails 15, 16. The guide rail section 43, 44 is carried by rods 45, 46, on which it can be withdrawn transversely from the guide rails 15, 16. For the service stations C1, C2 the arrangement corresponds to the service station B2, B4 of that described in the first embodiment.

The withdrawal mechanics of the service stations B1, B3 differ from those of the service stations B1, B3 of the second embodiment, insofar as, instead of the separated rods 23, 24 by which both guide rail sections 21, 22 can be withdrawn, one common guide rod 47 is employed. The rod 47 is likewise carried on a sliding bushing or a roller bearing. By means of the common rod 47, the constructive and apparatus complexity and cost is reduced for the pulling out of the spin-start robot 14*a*, 14*c* at the service stations B1, B3. Since, as a rule, by the maintenance personnel only one spin-start robot 14 can be serviced at one time, it is not necessary, that both spin-start robots are simultaneously brought into the pull out service station B1, B3. Likewise, a simultaneous dropout of the spin-start robot 14*a*, 14*b* is unlikely. Conversely, it is advantageous, to provide the withdrawable service stations C1, C2, which are independent of one another, at the level of the drive framework, which lies between the workstations 13. In normal operation, both service stations C1, C2 are not withdrawn, so that the guide rails 15, 16 are continuous and a spin-start robot can pass by without hindrance at the drive framework 42.

In the case of this fourth embodiment, the service stations C1, C2 can be installed additionally to, or on the location of the service stations B2, B4, A2, A4 at the height of the drive framework 12 or at the end of the rotor spinning machine 40. The arrangement of six service stations, would then be of value, if, per side or the rotor spinning machine 40, three spin-start robots were installed. As presented, in the case of the fourth embodiment, the six spin-start robots 14*a* to 14*f* are installed, whereby the central spin-start robots 14*e*, 14*f*, advantageously are serviced in the service station C1, C2, so that the two side located spin-start robots 14*a*, 14*b* or 14*c*, 14*d* can continue to serve the workstations 13 on both sides of the drive framework 42. On the end framing, that is to say, on the drive framework 12 (not shown here) there can be provided either an extended guide rail with a service station A1, A3, A2, A4 and/or a withdrawable service station at the height of the end framing or drive framework 11, 12 (B1, B2, B3, B4).

Modifications of the above presented embodiments are possible. For example, the common rod for two oppositely situated, withdrawable service stations at each end, or drive framework 11, 12, 42 can be provided. Further, the two sides of the rotor spinning machine need not be constructed as symmetrical in relation to the service station. The first side of the rotor spinning machine, can, in this matter, be designed in accord with one of the first to the fourth embodiments of the arrangement of the service stations, while the second side of the rotor spinning machine can be constructed according to another of the first to fourth embodiments of the arrangement of the service stations. The selection of the arrangement depends, on the one hand, as to whether or not on the corresponding side of the rotor spinning machine in the extension of the rotor spinning machine there is space allowable for an elongated guide rail, or whether or not along side of the rotor spinning machine there is room available for the withdrawing of the spin-start robot in the withdrawable service station.

It should be apparent to those skilled in the art that modifications and variations can be made to the embodiments of the invention described herein without departing from the scope and spirit of the invention as set forth in the claims and their equivalents.

What is claimed is:

1. A textile machine having a plurality of workstations disposed along a first side and a second opposite side, said textile machine further comprising:

a guide rail disposed along each of said first and second sides of said textile machine;

at least two maintenance apparatuses disposed along said first side, said maintenance apparatuses configured to travel on said respective guide rail to service said workstations along said first side;

a first maintenance apparatus service position defined along said first side and configured with respect to framing of said textile machine, said first maintenance apparatus service position comprising a transversely movable section of said guide rail such that a maintenance apparatus is movable generally transversely away from said workstations on said movable guide rail section and into said service position;

said guide rail extending beyond said textile machine framing at least at one end of said textile machine; and a second maintenance apparatus service position defined at said extended guide rail section beyond said work stations.

2. The textile machine as in claim 1, wherein said first maintenance apparatus service position is defined at an opposite end of said textile machine framing from said second maintenance apparatus service position.

3. The textile machine as in claim 1, further comprising at least two maintenance apparatuses disposed along said second side, said maintenance apparatuses configured to travel on said respective guide rail to service said workstations along said second side, and a third maintenance apparatus service position defined along said second side opposite from said first maintenance apparatus service position and configured with respect to framing of said textile machine such that a maintenance apparatus is movable generally transversely away from said workstations on a movable guide rail section and into said third maintenance apparatus service position.

4. The textile machine as in claim 3, wherein said guide rail along said second side extends beyond said textile machine framing at least at one end of said textile machine, and further comprising a fourth maintenance apparatus service position defined at said extended guide rail section beyond said work stations on said second side.

5. The textile machine as in claim 3, further comprising a curved guide rail section interconnecting said guide rails along said first and second sides such that said maintenance apparatuses can travel between said first and second sides.

6. A textile machine having a plurality of workstations disposed along a first side and a second opposite side, said textile machine further comprising:

a discrete guide rail disposed along each of said first and second sides of said textile machine;

said guide rail along said first side extending beyond framing of said textile machine at a first end and a second opposite end;

at least two maintenance apparatuses disposed exclusively along said first side, said maintenance apparatuses configured to travel on said respective guide rail to service said workstations along said first side;

a first maintenance apparatus service position defined at said extended guide rail section at said first end of said first side beyond said machine framing such that service access is provided to a back side of said maintenance apparatus; and a second maintenance apparatus service position defined at said extended guide rail section at said second end of said first side beyond said machine framing that such service access is provided to a back side of said maintenance apparatus.

7. The textile machine as in claim 6, further comprising at least two maintenance apparatuses disposed along said second side, said maintenance apparatuses configured to travel on said respective guide rail to service said workstations along said second side, said guide rail along said second side extending beyond said textile machine framing at least at one end of said textile machine, and further comprising a third maintenance apparatus service position defined at said extended guide rail section beyond said machine framing on said second side.

8. The textile machine as in claim 7, further comprising a fourth maintenance apparatus service position defined at an opposite extended guide rail section along said second side.

9. A textile machine having a plurality of workstations disposed along a first side and a second opposite side, said textile machine further comprising:

a guide rail disposed along each of said first and second sides of said textile machine;

at least two maintenance apparatuses disposed along said first side, said maintenance apparatuses configured to travel on said respective guide rail to service said workstations along said first side; and a first and a second maintenance apparatus service position defined along said first side, said first and second maintenance apparatus service positions comprising a transversely movable section of said guide rail such that a maintenance apparatus is movable generally transversely away from said work stations on said movable guide rail section and into said service positions.

10. The textile machine as in claim 9, wherein said first and second maintenance apparatus service positions are defined at opposite ends of textile machine framing.

11. The textile machine as in claim 9, further comprising at least two maintenance apparatuses disposed along said second side, said maintenance apparatuses configured to travel on said respective guide rail to service said workstations along said second side, and a third and a fourth maintenance apparatus service positions defined along said second side comprising transversely movable sections of said guide rail such that a maintenance apparatus is movable generally transversely away from said work stations and into said third or fourth maintenance apparatus service positions.

12. The textile machine as in claim 11, wherein said first and third maintenance apparatus service positions and said second and fourth maintenance apparatus service positions are disposed across from each other at opposite said sides of said textile machine and are configured on a common withdrawal mechanism such that maintenance apparatuses are alternately withdrawable at said first and third maintenance apparatus service positions and at said second and fourth maintenance apparatus service positions.

13. The textile machine as in claim 11, further comprising a curved guide rail section interconnecting said guide rails along said first and second sides such that said maintenance apparatuses can travel between said first and second sides.

* * * * *